United States Patent [19]

Johnson

[11] Patent Number: 4,753,148

[45] Date of Patent: Jun. 28, 1988

[54] SOUND EMPHASIZER

[76] Inventor: Tom A. Johnson, 213 Avenue C., Carrollton, Ga. 30117

[21] Appl. No.: 936,634

[22] Filed: Dec. 1, 1986

[51] Int. Cl.[4] ..... A63J 17/00

[52] U.S. Cl. ..... 84/464 R

[58] Field of Search ..... 84/464

[56] References Cited

U.S. PATENT DOCUMENTS

| | | | |
|---|---|---|---|
| 3,767,901 | 10/1973 | Black et al. | 364/200 |
| 3,804,503 | 4/1974 | Sissom | 84/464 |
| 4,241,295 | 12/1980 | Williams, Jr. | 364/400 |
| 4,392,187 | 7/1983 | Bornhorst | 364/400 |

*Primary Examiner*—L. T. Hix
*Assistant Examiner*—David Porterfield
*Attorney, Agent, or Firm*—Michael C. Smith

[57] ABSTRACT

A media loaded computerized sound emphasizer device for synchronizing a light show performance to music based upon active computer control instead of conventional passive sound control or inaccurate manual comprising a computer and media playback unit controlled by the computer, a power distribution unit, and one or more light units, wherein each song used with this apparatus cooperates with an individualized program thereby allowing the audience to experience the audio detail through the visual sense.

19 Claims, 2 Drawing Sheets

SOUND EMPHASIZER

TECHNICAL FIELD

The present invention relates generally to a method and apparatus for emphasizing sounds, and specifically to a media loaded computer device for synchronizing a light show performance to music based upon active computer control.

BACKGROUND ART

Light show control systems are well known in the art. U.S. patents related to light control are U.S. Pat. Nos. 3,767,901; 3,881,930; 4,241,295; and 4,392,187. Most light shows currently associated with music are run manually by an operator who must manipulate electrical switches in an effort to obtain the desired results. The present sound emphasizer is computer controlled and preprogrammed song by song. There are no known devices to perform the same task on a song by song basis. There are three basic types of light to music control systems in the prior art: manual control; light followers; and light organs. The manual type of light show depends totally on an individual to control a light to music performance by pressing or moving electrical switches when they desire a certain light or group of lights to come on. The operator must ensure that the timing of the lights coincide with the music. This type of operation is subject to a high level of mistakes when compared to the synchronization of the lights to the actual music being played. Therefore, prior art light synchronization in relationship to the music is at all times manually controlled by the operator. This type of device has no music source of its own and therefore all music must be supplied from an outside source. Light followers are generally dedicated processors which have one or more 'canned' computer type programs which may be called upon to control one or more lights. They generally also have a 'tempo' control circuit. Such programs dictate which lights will activate in relation to the other lights it controls. Typically, this device will contain up to a maximum of fourteen 'canned' programs which may be called upon by an operator. Since the operator cannot alter these 'canned' programs, they are totally limited to the available program sequences supplied. The 'tempo' control will allow for the speeding up or slowing down of the light sequences. Both the light sequences (canned programs) and the tempo must be manually set by an operator either immediately before or during the light performance. This prior art light synchronization in relationship to the music is at all times manually controlled by the operator, and frequently has to be adjusted to compensate for variances in the actual beat of the music. This type of device has no music source of its own and therefore all music must be supplied from an outside source. Light organs are generally constructed to be responsive to certain amplitudes of frequencies of music. Within a given frequency range, light organs turn on one or more lights. Other lights will also turn on when other amplitude or frequency ranges are sensed by the light organ. Therefore, this prior art device requires little or no attention because it is a 'dumb' device capable of repeatedly turning on the same group of lights no matter what the song is. The basic theory of the light organ provides for better light to music synchronization than the previously mentioned prior art devices, but has little or no operator control over the lights. Therefore, this device does not provide for any changes in the sequence of which light or series of lights will come on for a given amplitude. It also does not allow an operator to put any 'personality' into the light show for a given song. The light organ has no music source of its own and therefore all music must be supplied from an outside source. The majority of the prior art light show means in use are either conventional passive dependant sound controlled means or manual controlled means. Manual controlled means can often be inaccurate, and the passive sound control means lack desired sound emphasis. It is for this reason that the present sound emphasizer was invented. A major problem overcome by this device was the synchronization of computer control to music, because the computer deals only in real time, while bands who play music vary their best and therefore, do not maintain a real time beat. The present sound emphasizer allows a person to actually see the music they are hearing and greatly enhances their appreciation for that music. The present invention produces music and a light show synchronized thereto.

DISCLOSURE OF INVENTION

The present invention is a sound emphasizer which incorporates a media loaded computer device for synchronizing a light show performance to music based upon active computer control. It comprises a computer and media playback unit controlled by the computer, a power distribution unit, and one or more light units. Each song used with this apparatus cooperates with an individualized program. In this manner, the present invention allows the audience to experience audio detail through the visual sense. The present invention is constructed to be either a master or playback unit. The playback unit is capable of producing both the music and a light show which is synchronized to that particular song. This unit requires no operator assistance other than the insertion of a matched floppy disc and audio/video cassette. The floppy disc contains the computer program which will operate the lights and the audio/video cassette contains the music. Once these are inserted, the playback unit is capable of producing music and a light show synchronized to the music. This machine is capable of up to thirty-three consecutive light shows without any additional operator assistance other than reversing sides on the audio cassette. Using the present invention, a programmer can put his actual feelings of the music into a light show for a particular song. This device allows for the operator do a light show of unlimited combinations of lights and timing of those lights to a particular song. When the programming is complete, this unit will save the necessary computer data associated with that song on a floppy disc and if called upon to playback, will duplicate exactly the programming as it was when it was saved to the disc by the programmer. Up to thirty-three songs may be saved on a single disc. This disc and the associated audio/video cassette will compromise an album.

Thus, a major object of this invention is to provide apparatus to allow a music and light show audience to experience audio detail through the visual sense.

Another object of this invention is to overcome the problem of synchronizing a light show with actual music which does not maintain real time.

Yet another object of this invention is to provide sound emphasizing means wherein each song used cooperates with an individualized program which senses changes in music time and adjusts as needed to maintain synchronization.

Still another object is to provide means for producing music and a light show synchronized thereto.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from a following description taken in connection with the accompanied drawings in which like parts are given like identification numerals and wherein;

BEST MODE FOR CARRYING OUT THE INVENTION

Figure 1:
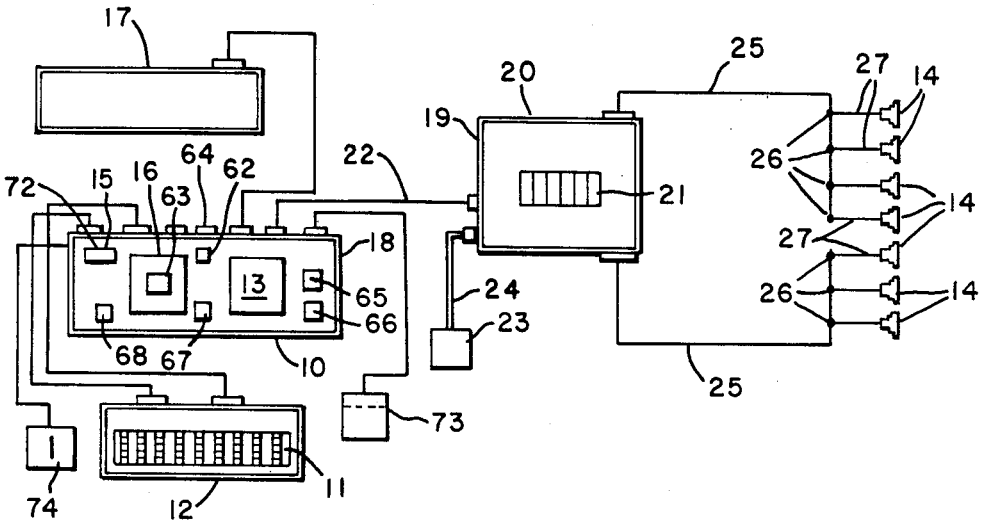
FIG. 1 is diagram of the major components of the present invention.

Referring now to FIG. 1, it can be seen that the present invention comprises a control unit 10 which provides for programming of various lights 14 and light responses to emphasize specific music. Keys 11 on the keyboard 12 are in communication with control unit 10. When a key 11 is depressed, a computer device 13 within control unit 10 is constructed to know which light 14 is associated with that particular key 11, and will activate that particular light 14 as long as corresponding key 11 is depressed. Computer 13 will remember programming by storing a sound emphasizer computer program on a magnetic or other type of emphasizer program media 15 in disc drive 72, preferrably in the form of a 3½ inch micro floppy disc 15. A separate music media 63 in playback unit 16 stores the actual music or music video on an audio/video tape 63 or similar device. Computer 13 can also recall the program from the media 15 and play back the program, which will activate lights 14 in accordance with the program. During playback, computer 13 synchronizes the computer's 13 program exactly with music. Control unit 10 also comprises playback unit 16 which is controlled by computer 13. A conventional sound system 17 including speakers and amplification means produces the sound. Control unit 10 contains the computer 13 and playback unit 16 in one cabinet 18. The playback unit 16 is preferrably a standard cassette, compact disc or video cassette type. Computer 13 controls all actions of playback unit 16 as prescribed by the computer programmer who programmed emphasizer media 15. The control unit 10 may be of two varieties, master or slave. Master devices 10 contain programming capability while slave devices do not. This promotes security of the system by preventing distribution of unauthorized programs. Individuals may purchase a master unit 10 and do their own programming, however, all their songs will playback only on their own device. They cannot take such programming and use it on any other control unit 10 because each unit has been coded as the programming was done. Prior to any playback, each unit 10 is engineered to confirm this code and will reject if the code of the system does not match the code on the tape 63 it is about to play. This is not true for general circulation songs programmed by the inventor. They will play on all units 10. This design prevents the corruption of the preprogrammed songs market by purchasers of the devices 10. Cabinet 18 size is approximately three feet wide, one foot high, and one foot deep. Micro floppy discs 15 containing emphasizer computer programs and separate music media cassette tapes 63 containing associated music are supplied for use with the slave unit 10. A wide variety of music is available. The computerized program is done on a master unit 10 which has such capability. The actual end user device will be slave unit 10 and will not have programming capability. The system also comprises a power distribution unit 19 in a separate cabinet 20 and contains a multiplicity of solid state relays 21 which are controlled by the computer device 13. A single relay 21 is responsible for a single light 14 circuit, therefore all light 14 circuits work independently from each other. Power distribution unit 19 can be mounted anywhere that is convenient to the end user and will be connected to the computer device 13 by a low voltage cable 22. Power distribution unit 19 is connected to an electricity source 23 by a cable 24 of the appropriate size for the amperage load which will be required by the lights 14. The voltage input to the power distribution unit 19 is 230 volts AC, one phase. The supplied 230 volt input is blocked from reaching the actual lights 14 by solid state relays 21 within the power distribution unit 19. Relays 21 will normally be in the off mode until the computer 13 turns them on, at which time, voltage will travel from the power source 23 through the power distribution unit 19 and through field wiring 25 to termination points 26 where the actual light wires 27 are attached. Termination points 26 can be either in the form of screw connectors where light wires 27 are placed underneath the screws and tightened down, or in the form of plug-in receptacles of the male and female variety. The power distribution unit 19 applies 120 volts AC and 120 volts DC to many of the light 14 circuits even though 230 volts AC, one phase is supplied into the input end of the unit 19. Some of the AC voltage is converted to 115 volts DC by unit 19 which is supplied to some lights 14 which are desired to have intensity variability, which will be explained below. The customer will supply the necessary one phase 230 volt power source which will terminate inside the distribution unit 19. It is the responsibility of the buyer of this system to supply the AC power source, and to ensure it's capacity to deliver the required 75 Amps at 230 volts to operate the system. Power distribution unit 19 is approximately four feet in length, two feet in width, and eighteen inches in depth.

Computer 13 comprises an 8085 a h-2, 8 bit microprocessor with an operating rate of 4.84 MHZ, a single clock cycle of 206 nanoseconds, a basic instruction cycle of 824 nanoseconds, and a 9.68 MHZ system clock. Word size for computer 13 is 8, 16 or 24 bits for instruction; 8 bits for data, and 16 bits for address. Maximum RAM access time is 200 nanoseconds. Computer 13 has a read only memory (ROM) capacity of 64K bytes, and a random access memory (RAM) capacity of 64K bytes. Computer 13 has a parallel I/O capacity of sixteen 8 bit I/O ports. Serial I/O capacity is an asynchronous channel with 8 bit characters, 2 stop bits, break character generation, false start bit detectors, and a 9600 baud rate. Computer 13 features a non-maskable interrupt and sixteen programmable, edge triggered interrupts. It also has timer/event counters including three 16 bit devices and three 8 bit devices which are programmable as to real-time interrupt, one shot, rate generator, square wave rate generator, software triggered strobe, and hardware triggered strobe. The computer 13 controller is a u PD765A F.D.C. type with a drive compatability of single density, double density, single sided, double sided, and 8 inch, 5¼ inch, or 3½ inch disc. It has a 16 MHZ system clock and a polled mode of operation. It is preferred that disc drive 72 is adapted for use with a double sided, double density 3½ inch microfloppy disc; that it have an unformatted 1 meg Byte storage capacity; and a transfer rate of 256 K bits per second. The computer's 13 switching power supply has capacities of +5 vdc at 15 amps, +12 vdc at 2 amps, −12 vdc at 2 amps and −5 vdc at 0.5 amps.

Figure 2:
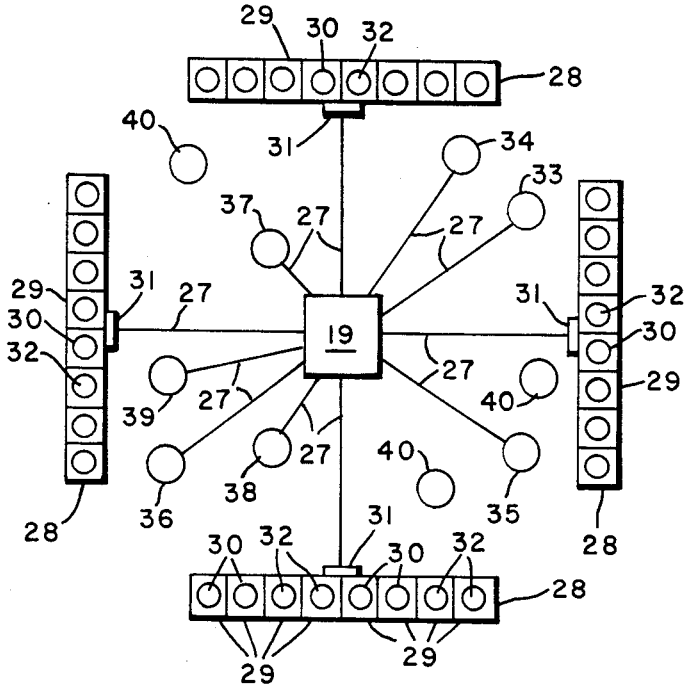
FIG. 2 is a view of the light system of the present invention.

As FIG. 2 illustrates, lights 14 are preferrably secured to four independently mounted and electrically isolated light bars 28, each ten feet in length. Each light bar 28 comprises eight light fixtures 29 containing one 150 watt, 120 volt flood bulb 30 per fixture 29. Each fixture 29 is electrically connected to a plug-in bar 31 located on top of light bar 28. Each plug-in bar 31 comprises a multiplicity of receptacles (not shown) electrically separated from each other, each receptacle being separately connected to the power distribution unit 19 via a multiple wire cable 27. Each light fixture 29 on the light bar 28 has a replaceable color lens 32 which causes the light emitted by the flood bulb 30 to change its color from white to the color of the lens 32. The lenses 32 are colored green, red, blue, or amber. These color lenses 32 correspond with the associated color coded keys 11 on the keyboard 12 and therefore, color integrity is maintained from control unit 10 through all associated cables 24, 25, 27 and the power distribution unit 19. Although light fixtures 29 are of a conventional variety, the mechanical and electrical engineering required to assemble the light bar 28 constitutes a unique product not available through any other source and is considered a part of the present invention. In addition to the four light bars 28, are one or more rotating light fixtures 33 each consisting of four 25 watt, 120 volt bulbs and are referred to as helicopter lights. Also included are one or more sirens 34, one or more police type blue rotating beacon lights 35, one or more sweep lights 36, one or more mirror balls 37 with required lights 38 which are normally mounted in the center of the light show area. A low power laser light 39 and associated mirrors 40 reflect the laser as deemed necessary throughout the light show area. More than fifty independent and fused light circuits have been engineered into the present invention including spare circuits which have been set aside for various optional uses. Each light bar 28 circuit has been designed to handle up to a 300 watt flood bulb 30 at 120 volts, and each special function light or device 33, 34, 35, 36, 37, 38, 39 circuit can handle up to 10 ampere loads at 120 volts AC.

Figure 3:
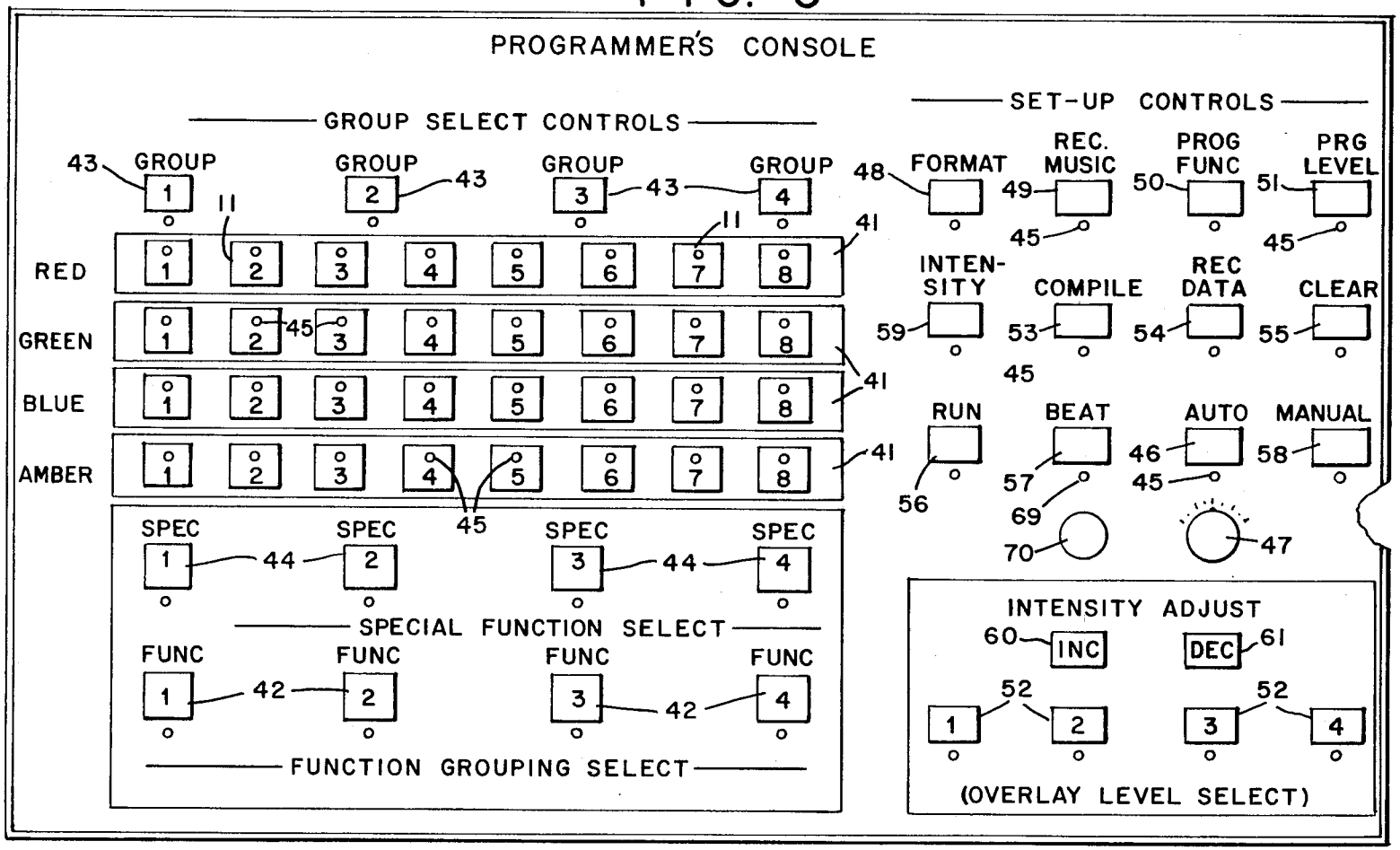
FIG. 3 is a view of the keyboard of the present invention.

FIG. 3 shows keyboard 12 in more detail. On the left of keyboard 12 are four keybanks 41 containing a total of thirty two keys 11, each key 11 controlling an individual light 14 of a light bar 28 as discussed above. All keys 11, 48, 50, etc. have an adjacent light emitting diode 45 which indicates activity of the key and its corresponding controlled device or light. Keyboard 12 is expandable to sixty-four keys, capable of controlling sixty-four separate lights 14 or other devices. While each keybank 41 is shown to contain an individual color key 11 corresponding to an identically colored light 14, the key banks 41 may comprise color variations which match the key bank 41 lay out to the light bar 28 layout. In addition to one light 14 per key 11 capability, the control unit 10 has the capability to tie in or latch any number or location of individual lights 14 to one single key called a function key 42. There are four such function keys 42 available. In order to utilize this feature, the programmer simply presses and releases program function key 50. All function keys 42 then begin to blink to prompt selection of a specific function. The selected function key 42 then stops blinking while all other function keys 42 turn off. The programmer then depresses any combination of light keys 11 to latch them to the selected function key 42. After all desired light keys 11 have been pressed, clear key 55 is depressed to complete latching of the selected keys 11 into the function. Until reprogrammed, the one function key 42 when depressed will turn on all the keys 11 associated with it in lieu of pressing the individual light keys 11. Above key banks 41 are a plurality of group keys 43 each of which controls a multiplicity of the individual light keys 11. Thus, by pressing one group key 43, the programmer can activate all lights 14 of a similar color. In the alternative, each group key 43 can control a specific light bar 28 instead of specific colors of lights 14. Any other combination of lights 14 or special function lights and devices 33, 34, 35, 36, 37, 38, 39, 40 may also be selected. Below key banks 41 are a plurality of specialty keys 44 which selectively control the special function lights and devices 33, 34, 35, 36, 37, 38, 39 discussed above. Each key 11 is color coded according to the light 14 it controls, and the keyboard layout is preferrably substantially identical to the physical positions of its corresponding light 14. Each key 11 also has a light emitting diode 45 built in, which is also color coded to the light 14 controlled by the key 11. This allows a programmer to program a light show and play it back without using the actual lights 14 associated with show. This decreases the electricity required for programming, and permits on site demonstrations of the present invention without having to install the entire lighting arrangement. A headphone circuit 64 with provisions for headphone playback is also incorporated, which allows programming to occur without using a conventional sound system. Auto key 46 controls an auto beat circuit to enhance programming of the light show. This feature allows the programmer to adjust a variable switch 47 to speed up or slow down the flashing of the associated light emitting diode 45 located on the keyboard 12. The programmer adjusts the light emitting diode 45 by rotation of switch 47 until it flashes in conjunction with the actual beat of the music which is about to be programmed. The programmer may then engage certain individual lights 14 using a function key 42 which ties the individual lights 14 together as one function. By placing the beat circuit switch 47 in the auto mode, all lights 14 associated with a particular function key will be activated every time the beat light emitting diode 45 is lit by the beat circuit. To adjust the beat circuit light emitting diode 45 to match approximate beat of music, function keys 42 are programmed to activate certain groups of lights. Auto key 46 is engaged, in lieu of having to depress function key 42 to make lights 14 come on, and the beat circuit will turn them on in accordance with established beat of the music.

There is also a pause mode. During the playback of any song, if the operator presses a cue key 65, which is located on the front panel of the unit 10, the current song will continue to playback normally. However, upon completion of that song and the 'loading up' of the next song, the unit 10 will stop all activity. To resume activity, an operator must press cue key 65 again. If desired, it is possible to skip from one song to another by pressing cue key 65 which will put unit 10 in pause mode then, pressing play key 66 as many times as necessary (1–33) to indicate which song is to be played at the end of the pause. During the pause, it is possible to change out the audio/video cassette if the desired song is on another side or on a tape 63 other than that currently being played. Pressing of cue key 65 will terminate pause mode and the unit 10 will seek out and execute the correct song desired to playback if it is on the tape 63 currently residing in the playback unit 16. Failure to press play key 66 during pause mode will cause pause mode to operate normally. Upon completion of the last song on the music tape 63, operators must remove and insert any other 'album' of their choice. 'Albums' consist of one floppy disc 15 and one or more audio/video music cassettes 63. The floppy disc 15 contains the computer's light show information while the cassettes 63 contain the music and necessary synchronization timing marks for each song. Each tape 63 and floppy disc 15 contain a specific identification number which not only identifies the album but which unit 10 may playback this album. These 'albums' must be created by a master sound emphasizer. The master unit 10 is essentially the same as the slave unit 10 with the exception of an added keyboard 12 which interfaces to the computer 13 inside the unit 10. Without this keyboard 12, programming is not possible. Essentially, any person may program any song using the keyboard 12. The keyboard 12 represents an access point in which any person may turn on and off a single light 14 or group of lights 14 they choose. During programming, while a song is being played from the cassette playback unit 16, a person will press a key 11 or group of keys 11 on the keyboard 12. Each key 11 is representative of an exact, physical location on light bars 28 and a specific color (amber, red, blue, green). The master unit 10 stores in its memory which keys 11 were pressed, the duration, and exactly where in the particular song the programmer pressed the key 11. During playback, the unit 10 will duplicate exactly in physical location, color and time the on and off sequences of all lights 14. In addition to the on/off sequences of lights 14, unit 10 controls the intensity or brightness of the lights 11.

Format key 48 is used to format the disc 15. Prior to any programming on a new floppy disc 15, that disc 15 must be 'formatted'. This process will write certain required computer data on to the floppy disc 15. This required data is then used by the master or slave unit 10 each time this particular disc 15 is used. To perform the format function, the operator presses the format key 48. The format key LED 45 will begin blinking to confirm the desire to format a floppy disc 15. The same key 48 is pressed again to start the process. Digital visual display 62 located on the front, top, center of unit 10 will prompt for an ID number. Each new disc 15 may contain a specific identification number associated with that particular disc 15. The operator presses the fast increase switch 60 once to increment the ID number up one digit starting always at zero. The operator may also press the fast decrease switch 61 to decrease this number. Once the correct number is being displayed within the visual display 62, clear/enter key 55 is pressed to actually begin the process of formatting the floppy disc 15. When all tracks have been successfully formatted, the process will stop automatically and await further instructions from the operator.

After the emphasizer program media 15 is formatted, original music is transferred to the computer 13 of control unit 10 by depression of the record music key 49. Prior to any programming being accomplished on the unit 10, music must be moved from an external music source (tape player, turntable, radio) to the audio/video music cassette 63 located in the playback unit 16. This transfer is accomplished using the record music key 49. When music located in another source is ready to transfer, the operator presses record music key 49. Unit 10 will activate playback unit 16 in order to position the tape 63 to receive the incoming music. Once the correct physical location on the tape 63 has been found by the unit 10, a cue light 67 on the unit 10 will come on. This is a signal to the operator to transfer the music to the unit 10 for recording on the tape 63. Upon completion of the song being transferred, the operator must touch the stop key 68 located on the face of the unit 10 to instruct unit 10 to terminate recording.

Program level key 51 is depressed in order to program the lights 14 to the music. There are four different levels of programming. This allows a programmer to program for music in as many as four separate stages or levels. The program level key 51 is depressed prior to specifying which level is to be programmed. The specific level key 52 is then depressed to begin programming. A basic light show is normally on level one, and specialized effects are on levels two, three and four. The final program is a combination of all four levels, which are stored on the computer program. Where identical lights 14 conflict between different levels, on takes precedence over off, thereby assuring that inactivity on one level does not cancel activity of another level. To program each level, the music is played by playback unit 16 as the programmer activates various individual keys 11, function keys 42, group keys 43, and specialty keys 44 to emphasize the music. When the song is completed, another level is programmed as the music is played again and the process is repeated for each level until all are completed. Since each level is programmed separately, corrections to the original program can be done selectively and will only affect the selected level. By depressing run key 56, all levels may be played back at the same time to view the entire light show. The various levels may then be edited as desired. By pressing the run key 56 and then pressing the appropriate level key 52 which is desired to playback and run key 56 again, the operator may replay a single level or a combination of levels which have been programmed. This allows for selective playback to review each level for editing purposes. After the appropriate programming changes are made, the compile key 53 is depressed to compile the data.

After successfully programming and playing back to the operators satisfaction, the computer program is ready to be 'saved' to the floppy disc 15 for permanent storage and retrieval. This is first accomplished by 'compiling' all the computer's program data. This compile function mixes all four program levels into one program and sets this data up to be stored on the emphasizer media 15. The operator presses compile key 53 and compile LED 45 will start blinking for him to confirm the desire to compile. He presses compile key 53 again and the compile process will begin and end. After successfully compiling the data, the operator is ready to dump this data physically onto the media 15. To accomplish this, he presses record data key 54. The process will begin immediately and will terminate when the digital visual display 62 begins showing how many songs are left of a possible thirty-three on that particular floppy disc 15.

Clear/enter key 55 is an operator entry key which applies to many different functions. Its primary purpose is to terminate a decision making process by an operator or to terminate (clear) a process which is currently going on.

Run key 56 tells the unit 10 to playback the current program which is residing in memory. It is used in conjunction with the program level keys 51. If the operator desires to playback only level one of the current program then he presses run key 56 to select the appropriate level (1–4), and presses run key 56 again to start the playback process. He may playback a single level or all levels at once.

Unit 10 has two basic modes of operation. They are auto (automatic) and manual. While in auto mode, the unit 10 will supply music and light show on demand from the selected albums. While in manual mode, computer 13 of unit 10 has no control over lights 14 or music at all. This mode is normally used in conjunction with an outside music source. The manual mode will allow any operator to perform a manual light show from the keyboard 12 in lieu of preselected albums. To activate manual mode of the device, the operator presses auto key 46 and auto key light 71 will go out. He presses manual key 58 to activate manual mode.

Beat key 57 is used only with the manual mode of the unit 10. Unit 10 has an internal electronic metronome (not shown) which may be adjusted manually by an operator. The operator presses beat key 57 once to display current setting of electronic metronome on beat light 69. To adjust the beat, beat adjust switch 70 is adjusted until beat key light 69 is beating in time to the music which is being supplied. Beat key 57 is then pressed again and all preselected lights 14 will start an on/off sequence in time with the beat key light 69. This beat of the lights 14 is manually adjusted using beat adjust switch 70 to keep lights 14 in time with music. Unit 10 has no control over synchronization of music to light show while in manual mode.

Light intensity is a special feature and is controlled during programming by intensity key 59. Intensity programming only affects the color lights 14. Other special light devices (helicopter, mirror ball, police lights, etc.) are not affected. As previously discussed, distribution unit 19 takes 120 volt AC voltage and rectifies this voltage to 120 volts DC for use with the intensity programming. In addition to switching voltage to lights 14 on and off, control unit 10 controls the amount of DC voltage (120 to 40 volts) which is allowed to pass through each of the color light 14 circuits. Lower voltage decreases the brightness of the color lights 14. There are four distinct levels of voltage output and, therefore, four distinct levels of brightness. According to the preferred embodiment, it is not possible to reduce the intensity of a single colored light 14 without affecting the remaining color lights 14. The four output levels are 40 volts, 65 volts, 95 volts and 120 volts. The exact voltage in the first three levels are adjustable by a conventional device. To program intensity, operators must press intensity key 59 once then press run key 56. Playback of current programming will occur, and intensity will default to a 120 volt level (full bright). The four level keys 52 are representative of the four different intensity levels with level four being the brightest and level one the dimmest. During intensity playback, the programmer may elect to adjust the brightness of the outputs to colored lights 14 to further emphasize the music as desired by simply pressing one of the four level keys 52. This level will remain until changed again by an operator or intensity programming is terminated by an operator pressing clear key 55. The sound emphasizer master unit 10 is the programming model. A master unit can easily be converted into a slave unit 10 or vice versa. The slave units 10 are the actual devices marketed. As an alternative, several master units may be required to separately program the several levels in order to allow the end user to have semi-master devices for their own in house programming. To use this product, the end user needs the sound emphasizer unit 10, an album (consisting of one or more cassette/video tapes 63 and a 3½ inch floppy disc 15), a light system, and a sound system 17. The customer will insert the cassette 63 into the playback unit 16 and the floppy disc 15 into the floppy disc drive 72. Nothing else is required except for the operator to press the play key 66. The computer program will load into memory from the floppy disc 15. The computer 13 will then activate the playback unit 16 looking for the music which resides there. Music and the synchronized light show will follow. Thereafter, the operation is automatic. Continuous music, unassisted by operators will continue for approximately one hour before the audio tape 63 must be turned around for side B. Up to three hours of music may be handled by a single album. Units 10 which incorporate a video cassette playback unit 73, display the video playback associated with the music on any conventional video device such as a television or comparable monitor.

Sound emphasizers are easy to use and require no special skills. Sound emphasizers will dramatically emphasize any existing music, thus allowing persons not only to hear the music but see it as well.

The actual light show synchronization to the music being played is in the hands of the programmer as he listens to the music and decides when certain lights 14 and devices 33-39 should be turned on or off. Light show synchronization to music is based entirely on the keyboard 11 input within a given elapsed time since the timing mark for that particular song was read by the unit 10. The computer program accepts these keyboard 11 entries and computes the elapsed time which has passed on the clock (not shown) from the reading of the timing mark. An input from the keyboard 11 is computed by the unit 10 to be a change in the original status (on to off or vice versa) of a given channel (light or device). The elapsed time when this change occurred and which light 14 or device 33-39 device (channel) was involved are then stored in the unit 10 memory. During playback, the unit 10 maps its way through the existing memory and in accordance with existing stored commands, it will turn on and off relays 21 in distribution unit 19 which in turn apply or terminate electrical power which goes to that channel (light 14 or device 33-39).

An additional option is the use of coin operation means 74 for the selection of a particular album for play by a customer, which is initiated by the insertion of coins or similar items of value.

The system is operated by a computer program which is written to facilitate the following required procedures necessary for the operation of the unit 10:

(1) Format a new floppy disc—Unit 10 accepts operator inputs as to ID number of album about to be programmed. Format procedure of a new disc 15 is performed by writing this ID number and copying other pertinent computer data including a boot program and program directory onto the new floppy disc 15 and the audio/video music tape 63 associated with the floppy disc 15.

(2) Record Music—Unit 10 computes the total number of songs already stored on a given disc 15. It then computes the exact physical location on tape 63 to locate new music. It then turns on playback unit 16 in fast forward to move tape 63 to the next available physical location for new music. It places a digital sync timing mark at that location on tape 63, and then allows the operator to record music to the cassette tape 63 from any outside source, via unit's 10 input channels.

(3) Identification Function—This feature records digital disc 15 I.D. and tape 63 I.D. information onto the cassette 63 for reading back during playback of the tape 63. The disc I.D. informs computer 13 whether or not the correct tape 63 is in use. The tape I.D. is a point for indicating where the tape's 63 program resides on the disc 15. This function also initializes the programming parameters.

(4) Copy Disc—This program produces a duplicate copy from a source disc to a new disc.

(5) Program Group Function—This allows the operator to latch combinations of lights to a single group key 43.

(6) Program Level Mode—This allows operators to pick one of four memory locations in which programming inputs from keyboard 11 will be stored. This feature allows programmers to program each song one level at a time, rather than trying to program an entire song in one pass. The level programming is saved in the random access memory of computer 13. The programmer may elect to program the Beat only in level One then do music instrument solos in level Two. This would leave levels Three and Four for the special effect lights to be programmed. Each level is distinct and can be played back level by level or mixed.

(7) Programming Mode—This mode recalibrates tape 63 by fast reversing tape 63 to its beginning to compensate for tape stretch. It fast forwards tape media 63 to the exact physical location of the last timing mark. It reads the timing mark off tape 63 and activates computer's clock (not shown). It then turns on audio output channels which go to an outside amplifier or similar device thus allowing previously recorded music to be heard through speakers 17 during programming. This feature accepts inputs from keyboard 12 in the form of operators pressing keys 11 when desired lights 14 should be on or off in order to emphasize music being played. It sends signals via computer cable 22 to distribution device 19 which will turn off or on a given light 14 or device 33-39 in accordance with the keyboard 12 input. It stores all entries from keyboard 12 in memory and therefore is able to duplicate all entries during playback mode.

(8) Programming Playback—The programming playback feature allows operators to playback current music and light show being programmed prior to permanent media 15 storage. The computer program will calibrate cassette media 63 by fast reversing to physical beginning of tape 63 then, fast forwarding to precise physical location on the tape 63 of the last timing mark. It reads the timing mark and therefore starts the computer's 13 clock running. It turns on audio outputs so that recorded music can be heard through speakers 17. It turns on and off relays 21 in distribution device 19 in accordance with commands now stored in all memory locations which were previously programmed from the keyboard 12.

(9) Intensity—The intensity feature provides four distinct levels of voltage output to the color lights 14, thereby adjusting the brightness of these lights. 14 Distribution device 19 has rectifying capability which converts AC voltage to DC voltage. DC voltage is easier to vary than AC voltage. After rectification, this voltage is then fed to the relays 21 which actually turn on and off the lights 14. The computer program will store which level was turned on throughout music and is capable of exactly replaying these levels. All the color lights 14 are fed through same intensity circuits and therefore it is not possible to vary the intensity of a single color light 14.

(10) Compile Data—The Compile Data program mixes the existing separate Four levels of programming into a single computer program preparatory to being saved on the floppy disc 15.

(11) Record Data—This provides the ability for the unit 10 to store on a 3½ inch floppy disc magnetic media 15 the current light show programming. It also updates the disc directory.

(12) Manual Mode—The manual mode allows operators direct access from keyboard 11 to lights 14 and devices 33-39. No memory or media is used. It allows for use of special features like beat light circuit. While in manual mode, if an operator presses a key 11 on the keyboard 12, the associated relay 21 in the distribution device 19 will immediately react to the change by turning on or off the light 14 associated with that key 11.

(13) Auto Play Mode—This computer program provides for the automatic playback of all songs within a given album. The operator inserts the matched floppy disc 15 and audio/video tape 63 and presses the play switch 66 which is located on the front panel of unit 10. The computer program will read ID marks of both and then begin an automatic process of loading the computer data from the floppy disc 15 into memory and playing the music located on the tape media 63. Upon completion of each song, this process will repeat itself until the last song on the tape media 63 has been played at which time device will stop all activity.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the entertainment industry and is particularly useful in a music and light show system.

I claim:

1. Apparatus for emphasizing music of a light show with lights and other devices comprising:

computer means;

media playback means controlled by said computer;

one or more music emphasizing means, further comprising a multiplicity of colored lights, one or more sirens, one or more rotating light fixtures, one or more police type rotating beacon lights, one or more slow rotation sweep lights, one or more reflection means with associated lights, and more or more low power laser lights with associated reflection means, further provided that each of said colored lights emit a green, red, blue or amber light and said colored lights are mounted upon one or more elongated light bars, all of which are controlled by said computer;

power distribution means in communication with said computer means and with said music emphasizing means for distributing power to said music emphasizing means at the direction of said computer;

access means for entering data into said computer further comprising a keyboard having a multiplicity of entry keys for entering data into said computer to control each of said emphasizing means, and a light emitting diode associated with each key to indicate the operation of the emphasizing means controlled by the associated key, further provided that each light emitting diode associated with a key for controlling a colored light is color coded to match the color of the colored light and said keyboard has one or more key banks having a physical layout of keys corresponding to the physical layout of colored lights on said light bars; and a sound system.

2. The apparatus of claim 1 comprising one or more function keys adapted to latch a variety of individual keys of said keyboard into a single function such that the activation of a function key will cause all other selected individual keys and emphasizing means associated therewith to activate.

3. The apparatus of claim 2 wherein there are four separate function keys and wherein each function is programmed by use of a program function key.

4. The apparatus of claim 1 comprising one of more group keys, each of which controls a multiplicity of keys and corresponding emphasizing means.

5. The apparatus of claim 4 wherein a group key controls all colored light of a similar color.

6. The apparatus of claim 4 wherein a group key controls all colored lights on a light bar.

7. The apparatus of claim 4 comprising an automatic beat circuit for causing one or more emphasizing means to activate in time with beat of the music.

8. The apparatus of claim 7 comprising:

an auto key for activating the automatic beat circuit;

a beat circuit light emitting diode for indicating the beat; and a variable beat switch for regulating the speed of said beat.

9. The apparatus of claim 8 wherein said automatic beat circuit controls emphasizing means selected with a function key.

10. The apparatus of claim 1 comprising a cue key for activating and de-activating a pause mode during which operation of the system ceases; a play key for selecting a particular song and a corresponding program for operation of said emphasizing means; and a digital visual display means for indicating which song and corresponding program is played.

11. The apparatus of claim 1 further comprising:

means for keeping time;

means for receiving data;

means for storage of data;

means for retrieving data;

disc drive means for driving an emphasizer program disc;

a format key for formatting a new disc placed in said disc drive, and a format light emitting diode associated with said format key to prompt the format process;

digital visual display means for indication of specific identification numbers associated with the disc; and a fast increase switch for increasing the number displayed by said visual display means.

12. The apparatus of claim 11 comprising a fast decrease switch for decreasing the number displayed by said visual display means.

13. The apparatus of claim 12 comprising means for programming said disc with one or more separate program levels of emphasizing means control.

14. The apparatus of claim 13 comprising a program level key for programming one of four separate levels of emphasizing means control programming and a specific level key for selection of the specific level to be programmed.

15. The apparatus of claim 14 wherein conflicts between various levels concerning the control of an identical emphasizing means is resolved in favor activation of said emphasizing means.

16. The apparatus of claim 15 comprising a run key for viewing operation of said emphasizing means at the direction of one or more levels of said programs.

17. The apparatus of claim 16 comprising a compile key for compiling all levels into a single program to be stored on said disc.

18. The apparatus of claim 17 comprising a record data key for recording said single program on said disc.

19. The apparatus of claim 18 comprising a run key for viewing one or more levels of operation of emphasizing means at the direction of said program.

* * * * *